US007808179B2

(12) United States Patent
Nagano

(10) Patent No.: US 7,808,179 B2
(45) Date of Patent: Oct. 5, 2010

(54) PLASMA DISPLAY PANEL

(75) Inventor: Shinichiro Nagano, Suwon-si (KR)

(73) Assignee: Samsung SDI Co., Ltd., Gongse-dong, Gineung-gu, Yongin-si, Gyeonggi-do (KR)

( * ) Notice: Subject to any disclaimer, the term of this patent is extended or adjusted under 35 U.S.C. 154(b) by 112 days.

(21) Appl. No.: 12/314,385

(22) Filed: Dec. 9, 2008

(65) Prior Publication Data

US 2009/0224671 A1 Sep. 10, 2009

(30) Foreign Application Priority Data

Mar. 7, 2008 (KR) ..... 10-2008-0021658

(51) Int. Cl.
*H01J 17/49* (2006.01)

(52) U.S. Cl. ..... 313/582; 313/584

(58) Field of Classification Search ..... 313/582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |

FOREIGN PATENT DOCUMENTS

| | | | |
|---|---|---|---|
| CN | 1327253 | A | 12/2001 |
| CN | 101114561 | A | 1/2008 |
| JP | 2845183 | | 10/1998 |
| JP | 2917279 | | 4/1999 |
| JP | 2001-043804 | | 2/2001 |
| JP | 2001-325888 | | 11/2001 |
| JP | 2002-056779 | | 2/2002 |
| KR | 1020060000758 | A | 1/2006 |
| KR | 1020070041440 | A | 4/2007 |
| KR | 1020070122243 | A | 12/2007 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

*Primary Examiner*—Vip Patel
(74) *Attorney, Agent, or Firm*—Robert E. Bushnell, Esq.

(57) ABSTRACT

A plasma display panel that shortens the delay time of an address discharge by providing an exoelectron emission layer on a protective layer is disclosed. The plasma display panel includes first and second substrates facing each other and spaced apart from each other, barrier ribs arranged between the first and second substrates and defining discharge cells, phosphor layers formed within the discharge cells; address electrodes formed on the first substrate and extending along a first direction, first and second electrodes formed on the second substrate and extending along the second direction, a protective layer formed in a discharge region of the discharge cells, and an exoelectron emission layer formed outside the discharge region.

20 Claims, 6 Drawing Sheets

PLASMA DISPLAY PANEL

CLAIM OF PRIORITY

This application makes reference to, incorporates the same herein, and claims all benefits accruing under 35 U.S.C. §119 from an application earlier filed in the Korean Intellectual Property Office on 7 Mar. 2008 and there duly assigned Serial No. 10-2008-0021658.

BACKGROUND OF THE INVENTION

1. Field of the Invention

The present invention relates to a plasma display panel (PDP). More particularly, the present invention relates to a plasma display panel that protects an exoelectron emission layer provided on a protective layer from discharge sputtering.

2. Description of the Related Art

Generally, a plasma display panel (PDP) is a display device that excites phosphors with vacuum ultraviolet (VUV) rays radiated from plasma obtained through gas discharging, and displays desired images by using visible light of red (R), green (G), and blue (B) colors generated as the phosphors stabilizes.

In one example, in an alternating current type of plasma display panel, address electrodes are formed on a rear substrate and covered by a dielectric layer. Between the address electrodes, barrier ribs are disposed in a striped arrangement on the dielectric layer. Phosphor layers of red (R), green (G), and blue (B) are formed, respectively, on the inner surfaces of the barrier ribs.

A sustain electrode and a scan electrode are formed in a direction that crosses the address electrodes on the front substrate that faces the rear substrate. A dielectric layer and a MgO protective layer are consecutively formed, covering the display electrodes.

A discharge cell is formed at each area where the address electrodes on the rear substrate cross a sustain electrode and a scan electrode on the front substrate. Accordingly, in the plasma display panel, more than millions of discharge cells are arranged in a matrix shape.

In the discharge cells, portions exposed to a discharge space are phosphor layers that are formed on the rear substrate and the barrier ribs and an MgO protective layer that is formed on the front substrate. The MgO protective layer emits secondary electrons by collision with ions and electrons that are formed within the discharge cells upon a discharge. That is, the MgO protective layer lowers a discharge initiation voltage by emitting secondary electrons.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention relates to a plasma display panel that shortens the delay time of an address discharge by providing an exoelectron emission layer on a protective layer.

Furthermore, the present invention relates to a plasma display panel that improves the negligible stability of an exoelectron emission layer by protecting the exoelectron emission layer from discharge sputtering.

A plasma display panel according to one exemplary embodiment of the present invention includes a first substrate, a second substrate facing the first substrate, barrier ribs arranged between the first and second substrates and defining discharge cells, phosphor layers formed within the discharge cells, address electrodes formed on the first substrate and extending along a first direction, first and second electrodes formed on the second substrate and extending along a second direction, a protective layer formed between the first and second substrates, and an exoelectron emission layer formed between the first and second substrates. The protective layer is formed in a discharge region of the discharge cells, and the exoelectron emission layer is formed outside the discharge region.

A plasma display panel further comprises a dielectric layer covering the first electrodes and second electrodes. The protective layer is formed on the dielectric layer, and the exoelectron emission layer covers a part of the protective layer.

Each of the first and second electrodes may include a bus electrode extending in the second direction, a transparent electrode extending in the second direction parallel to the bus electrode, and a connecting portion for connecting the transparent electrode to the bus electrode. The transparent electrode of one of the first electrodes and the transparent electrode of one of the second electrodes form a discharge gap. The connecting portion may be arranged at a center between two of the barrier ribs, both of which extend along the first direction.

The exoelectron emission layer may be formed to cover a region between two adjacent discharge cells that are arranged in the first direction. The exoelectron emission layer may be formed to cover bus electrodes of the nearest first and second electrodes. The exoelectron emission layer may be formed to cover a region between the bus electrodes of the nearest first and second electrodes.

The exoelectron emission layer may be formed of a mixture of exoelectron emitter particles and an insulating material. The insulating material may include $Al_2O_3$.

The exoelectron emitter particles may be formed of MgO crystal particles or MgO-containing particles. The exoelectron emission layer may include MgO crystal particles and $Al_2O_3$ particles, and the MgO crystal particles and the $Al_2O_3$ particles may have a particle diameter smaller than 200 nm. The exoelectron emission layer may include MgO-containing particles and $Al_2O_3$ particles, and the MgO-containing particles may have a particle diameter smaller than a wavelength of vacuum ultraviolet rays generated during a discharge.

The exoelectron emission layer may include particles having a particle diameter smaller than 200 nm.

A plasma display panel according to another exemplary embodiment of the present invention includes first and second substrates facing each other and spaced apart from each other, barrier ribs arranged between the first and second substrates and defining discharge cells, phosphor layers formed within the discharge cells, address electrodes formed on the first substrate and extending along a first direction, first and second electrodes formed on the second substrate and extending along the second direction, and an exoelectron emission layer formed covering the bus electrodes of the first and second electrodes. Each of the first and second electrodes comprises a bus electrode extending in the second direction, a transparent electrode extending in the second direction parallel to the bus electrode, and a connecting portion for connecting the transparent electrode to the bus electrode. The transparent electrode of one of the first electrodes and the transparent electrode of one of the second electrodes form a discharge gap.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

Exemplary embodiments according to the present invention will now be described in detail with reference to the accompanying drawings so that a person skilled in the art can readily understand and carry out the invention. However, the present invention can be realized in various ways, and is not limited to the embodiments described herein. In order to describe the present invention more clearly, parts that are not related to the description will be omitted from the drawings, and the same symbols will be given to similar parts throughout the specification.

Figure 1:
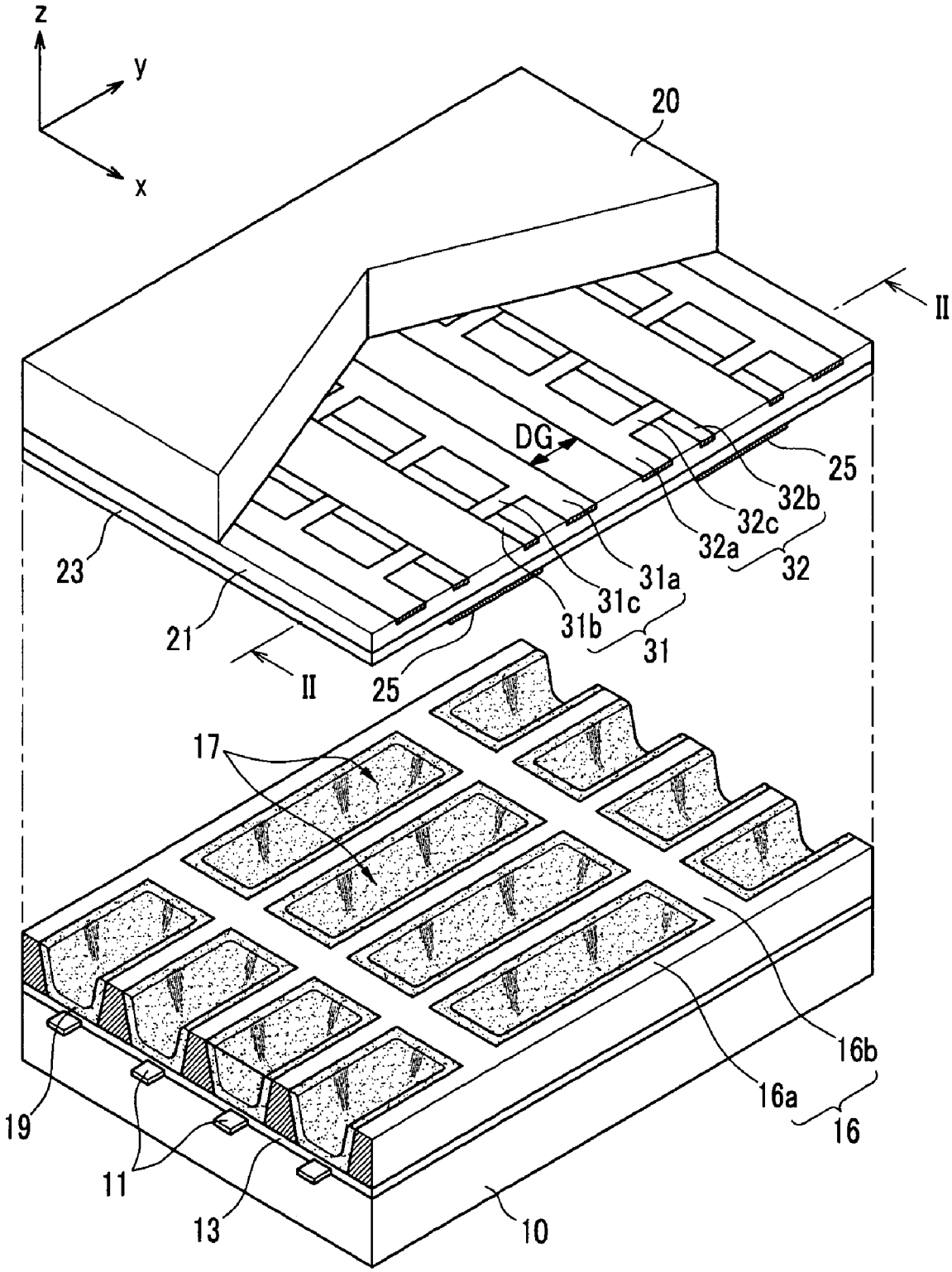
FIG. 1 is an exploded perspective view of a plasma display panel according to a first exemplary embodiment of the present invention.
Figure 2:
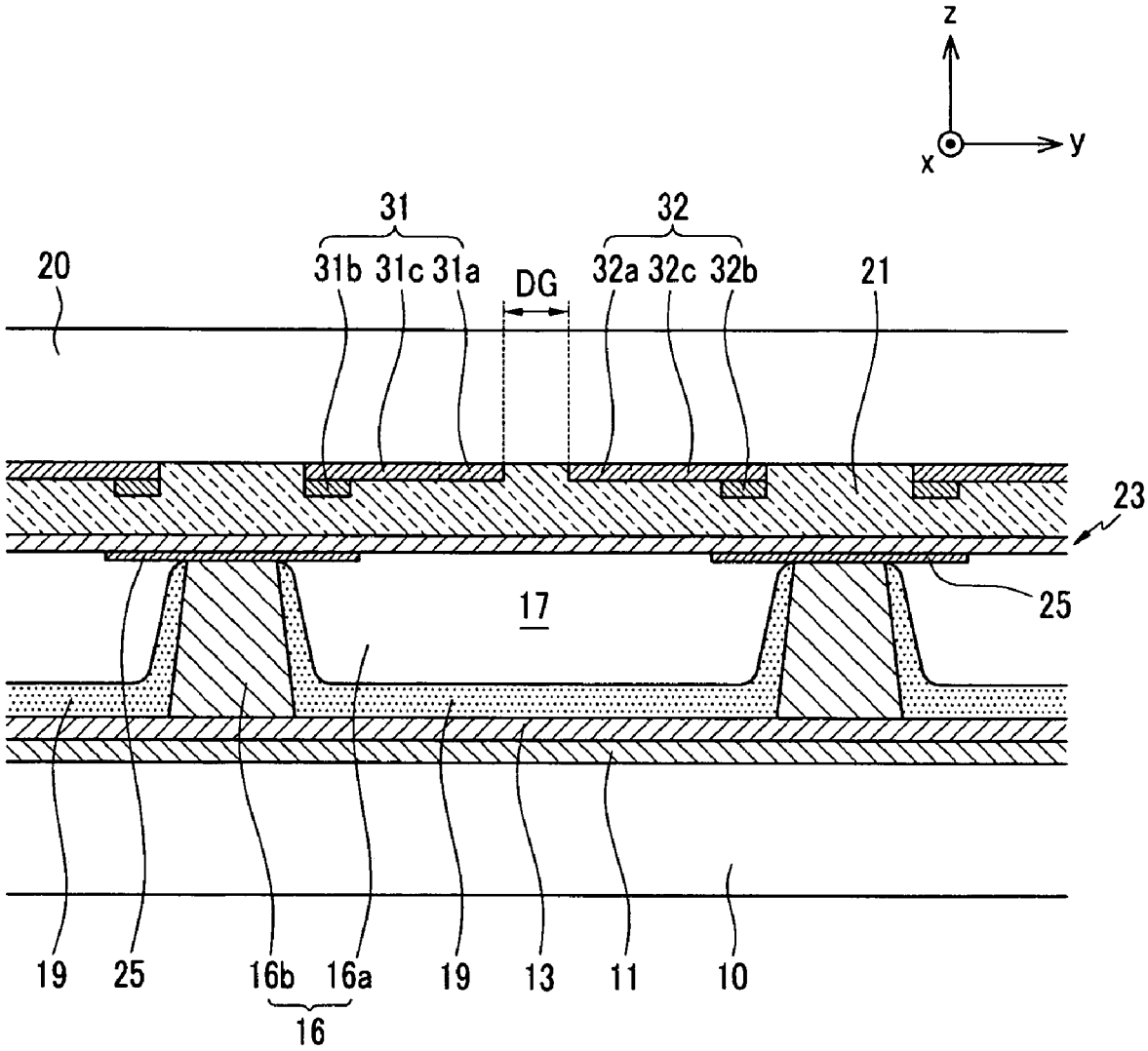
FIG. 2 is a cross-sectional view taken along line II-II of FIG. 1.

FIG. 1 is an exploded perspective view of a plasma display panel according to one embodiment of the present invention, and FIG. 2 is a cross-sectional view taken along line II-II of FIG. 1.

Referring to FIG. 1 and FIG. 2, a plasma display panel according to an exemplary embodiment includes a first substrate (hereinafter referred to as a rear substrate) 10 and a second substrate (hereinafter referred to as a front substrate) 20 facing each other with a preset interval therebetween and sealed to each other, and barrier ribs 16 provided between the substrates 10 and 20. The barrier ribs 16 are formed at a predetermined height between the first (rear) substrate 10 and the second (front) substrate 20 to define a plurality of discharge cells 17. The discharge cells 17 are filled with a discharge gas (e.g., a mixture gas including neon (Ne) and xenon (Xe)) to create vacuum ultraviolet rays using a gas discharge. The discharge cells 17 have phosphor layers 19 for absorbing the vacuum ultraviolet rays and emitting visible light. To induce a gas discharge in the discharge cells 17, address electrodes 11, first electrodes (hereinafter, "sustain electrodes") 31, and second electrodes (hereinafter, "scan electrodes") 32 are formed between the rear substrate 10 and the front substrate 20 corresponding to the respective discharge cells 17.

Figure 3:
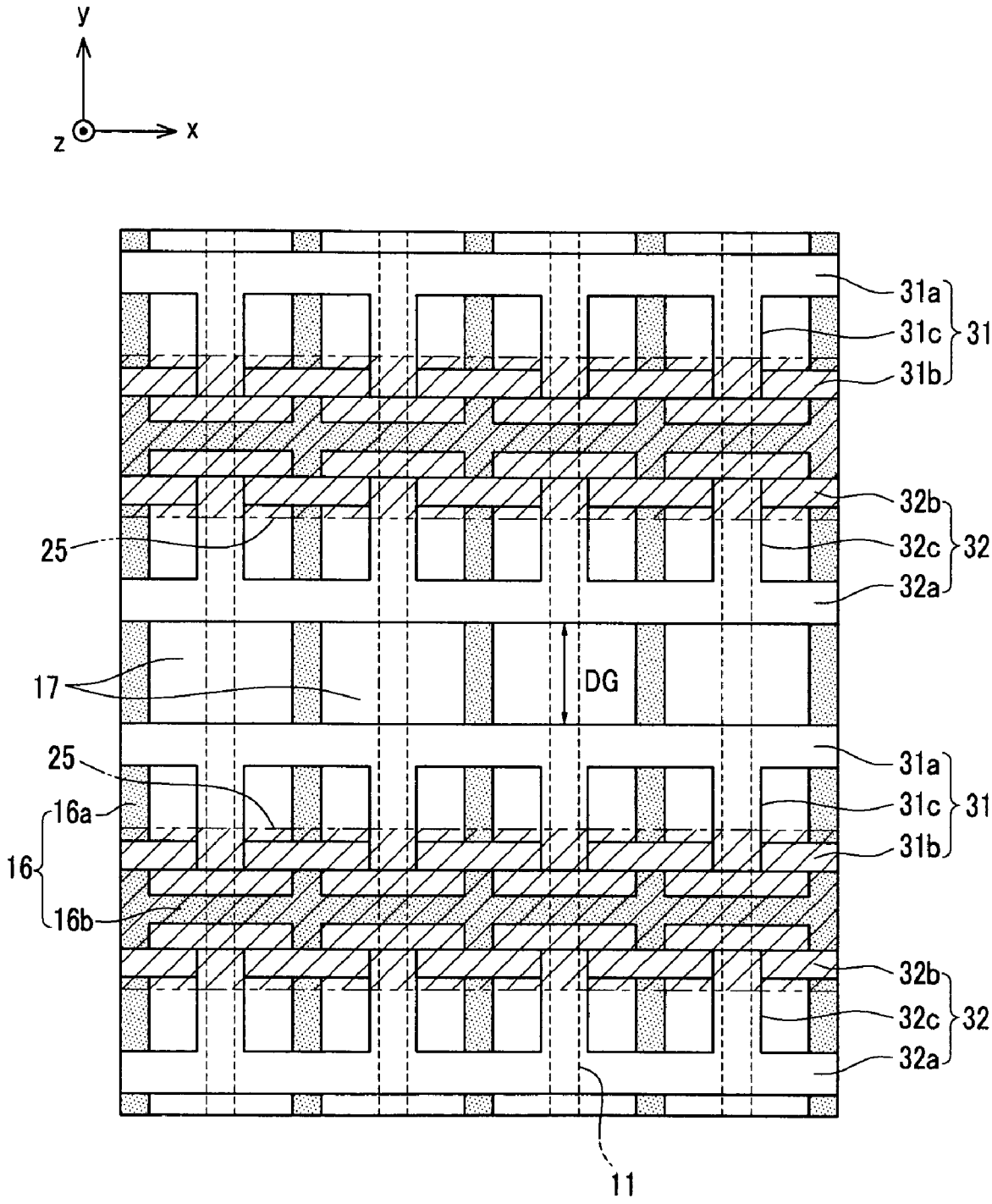
FIG. 3 is a plane view illustrating an arrangement relationship between discharge cells and electrodes in FIG. 1.

FIG. 3 is a plane view illustrating an arrangement relationship between discharge cells and electrodes in FIG. 1.

Referring to FIG. 3, the address electrodes 11 extend in a first direction (the y-axis direction in the drawings) on an inner surface of the rear substrate 10, and pass the discharge cells 17 that are adjacent to each other along the y-axis direction. In addition, the address electrodes 11 are arranged in parallel to each other, and each of the address electrodes 11 corresponds to one of sets of the discharge cells 17 that are arranged along the first direction.

Referring again to FIGS. 1 and 2, a first dielectric layer 13 covers the address electrodes 11 and the inner surface of the rear substrate 10. The first dielectric layer 13 prevents the address electrodes 11 from being damaged by positive ions or electrons. The first dielectric layer 13 protects the address electrodes 11 from collision with the positive ions or electrons. In addition, the first dielectric layer 13 provides a space where wall charges are accumulated.

Since the address electrodes 11 are arranged on the rear substrate 10 so as not to interfere with the irradiation of the visible light frontward, the address electrodes 11 may be formed of a non-transparent material. The address electrode 11 may be formed of a metal electrode having excellent electrical conductivity.

The barrier ribs 16 are provided on the first dielectric layer 13 to define the discharge cells 17. For example, the barrier ribs 16 include first barrier rib members 16*a* extending along the y-axis direction and second barrier rib members 16*b* extending along the x-axis direction and connecting two of the first barrier rib members 16*a*. The first and second barrier rib members 16*a* and 16*b* define the discharge cells 17. The discharge cells 17 are arranged in a two-dimensional array, and each of the discharge cells 17 is surrounded by the first and second barrier rib members 16*a* and 16*b*.

Alternatively, the barrier ribs include only first barrier rib members extending along the y-axis direction. The first barrier rib members thus form the discharge cells in a stripe structure (not shown). In this case, the discharge cells have a structure that is open along the y-axis direction.

In the first exemplary embodiment, the barrier ribs 16 define the discharge cells 17 in the matrix structure. From this matrix structure, when the second barrier rib members 16*b* are removed, discharge cells formed in the stripe structure by the first barrier rib members 16*a* can be formed. Therefore, a drawing illustrating the stripe structure has been omitted herein.

The phosphor layers 19 are formed on side surfaces of the barrier ribs 16 forming the discharge cells 17. For example, the phosphor layers 19 are formed on side surfaces of the barrier ribs 16 and a surface of the first dielectric layer 13 disposed between the barrier ribs 16. The phosphor layers 19 are formed by applying fluorescent paste to the discharge cells 17 and drying and firing the fluorescent paste.

The phosphor layers 19 formed in the discharge cells 17 arranged along the y-axis direction are formed of phosphors that generate visible light having the same color. The phosphor layers 19 formed in the discharge cells 17 arranged along the x-axis direction are sequentially formed of phosphors that generate red (R), green (G), or blue (B) color.

Referring to FIG. 3 again, the sustain and scan electrodes 31 and 32 are provided on an inner surface of the front substrate 20 to form a surface discharge structure corresponding to each discharge cell 17. The sustain and scan electrodes 31 and 32 are formed to extend along the x-axis direction crossing the address electrodes 11.

Each of the sustain and scan electrodes 31 and 32 respectively includes a transparent electrode 31*a* and 32*a* for inducing a discharge, a bus electrode 31*b* and 32*b* for supplying a voltage signal to the transparent electrode 31*a* and 32*a*, and a connecting portion 31*c* and 32*c* for connecting the transparent electrode 31*a* and 32*a* to the bus electrode 31*b* and 32*b*.

The transparent electrodes 31*a* and 32*a* are provided to induce a surface discharge in the discharge cells 17. In order to obtain a sufficient aperture ratio of the discharge cells 17, the transparent electrodes 31*a* and 32*a* are formed of a transparent material such as indium tin oxide (ITO).

The transparent electrodes 31*a* and 32*a* are formed to extend along the x-axis direction in parallel to each other, and to pass the central area of the discharge cells 17, thus forming a discharge gap (DG) between the transparent electrodes 31*a* and 32*a* around the center of the discharge cells 17. In addition, the transparent electrodes may be projected so as to independently correspond to each discharge cell (not shown).

The bus electrodes 31*b* and 32*b* are formed of a metal having excellent electrical conductivity in order to compensate for the high electrical resistance of the transparent electrodes 31*a* and 32*a*.

The bus electrodes 31*b* and 32*b* are formed to extend along the x-axis direction in parallel to each other. Therefore, the transparent electrodes 31*a* and 32*a* and the bus electrodes 31*b* and 32*b* are arranged in parallel to each other in the discharge cells 17.

The bus electrodes 31*b* and 32*b* may be formed within the discharge cells 17 around edge areas of the discharge cells 17. In addition, if sufficient space is provided in non-discharge regions between the discharge cells adjacent to the y-axis, the bus electrodes may be formed at outer portions of the discharge cells (not shown).

The connecting portions 31*c* and 32*c* are arranged within the discharge cells 17. In this case, in order to minimize blocking of visible light transmitting forward in the discharge cells 17, the connecting portions 31*c* and 32*c* may be formed of the same material as that of the transparent electrodes 31*a* and 32*a*. In the first exemplary embodiment, the connecting portions 31*c* and 32*c* may be formed of ITO.

The connecting portions 31*c* and 32*c* extend in the y-axis direction to electrically connect the bus electrodes 31*b* and 32*b* to the transparent electrodes 31*a* and 32*a*, respectively, and are arranged to pass the discharge cells 17 along a central line, which is parallel to the first barrier rib members 16*a* and is formed at a center between two of the first barrier rib members 16*a*, as shown in FIG. 3. Therefore, when a voltage signal is supplied to the bus electrodes 31*b* and 32*b*, the voltage signal is transmitted to the transparent electrodes 31*a* and 32*a* via the connecting portions 31*c* and 32*c*, respectively.

Referring again to FIGS. 1 and 2, a second dielectric layer 21 covers the address electrodes 11 and the inner surface of the rear substrate 10. The second dielectric layer 21 protects the sustain electrodes 31 and scan electrodes 32 during a gas discharge.

The second dielectric layer 21 prevents the sustain electrodes 31 and the scan electrodes 32 from being damaged by positive ions or electrons that could directly collide with the sustain electrodes 31 and the scan electrodes 32. In addition, the second dielectric layer 21 provides a space where wall charges are accumulated.

The second dielectric layer 21 is covered by a protective layer 23. For instance, during a discharge, the protective layer 23 protects the second dielectric layer 21 and emits secondary electrons, a number of which depends on a secondary electron emission coefficient.

With respect to the discharge cells 17, the protective layer 23 may be formed only in discharge regions in which discharge is generated, or and may be formed in both of the discharge regions and outer portions of the discharge regions (hereinafter, "non-discharge regions") in which no discharge is generated. In the first exemplary embodiment, the protective layer 23 is formed over all regions including the discharge regions and the non-discharge regions.

The transparent electrode 31*a* and 32*a* and the bus electrodes 31*b* and 32*b* are spaced apart from each other along the y-axis direction, and are connected to each other by the connecting portions 31*c* and 32*c*, respectively. The connecting portions 31*c* and 32*c* have fine widths in the x-axis direction, and therefore, a discharge generated around the transparent electrodes 31*a* and 32*a* may not be diffused to portions of the bus electrodes 31*b* and 32*b*.

Therefore, a discharge region is defined in a discharge cell 17 as portions around the transparent electrodes 31*a* and 32*a* and a space between the transparent electrodes 31*a* and 32*a*, which is defined by a discharge gap (DG). A non-discharge region is defined as portions excluding the discharge region. The portions corresponding to the transparent electrodes 31*a* and 32*a* are included in the discharge regions, and the portions corresponding to the bus electrodes 31*b* and 32*b* are included in the non-discharge regions. The discharge regions may include part of the connecting portions 31*c* and 32*c* that are adjacent to the transparent electrodes 31*a* and 32*a*.

An exoelectron emission layer 25 is formed in the non-discharge regions. The exoelectron emission layer 25 is formed so as to emit priming electrons required for initiating a discharge, i.e., exoelectrons.

The exoelectron emission layer 25 is less damaged by collision of positive ions generated during a discharge because it is formed in the non-discharge regions, thus continuously emitting exoelectrons even after longtime use of a plasma display panel. That is, the exoelectron emission layer 25 maintains negligible stability. Therefore, the delay time of an address discharge is shortened during the lifespan of the plasma display panel.

The exoelectron emission layer 25 may be formed in various structures according to the formation structure of the protective film 23. For instance, as shown in FIGS. 1 and 2, if the protective layer 23 is formed in the entire regions of the discharge cells 17, the exoelectron emission layer 25 is formed on the protective layer 23 in the non-discharge regions. That is, the exoelectron emission layer 25 covers part of the protective layer 23. The exoelectron emission layer 25 may be formed in a patterning method or dispensing method.

In addition, if the protective layer is formed in a pattern corresponding to the discharge regions, the exoelectron emission layer may be formed in a pattern corresponding to the non-discharge regions where no protective layer is formed (not shown).

Referring again to FIG. 3, the exoelectron emission layer 25 extends in the x-axis direction, and has a width, defined along the y-axis direction, which is slightly larger than the distance between two adjacent discharge cells 17. The exoelectron emission layer 25 is formed to cover the bus electrodes 31*b* and 32*b* and the second barrier rib member 16*b* that is formed between the bus electrodes 31*b* and 32*b*. Therefore, some of ions or electrons generated in the discharge regions are drawn close to the bus electrodes 31*b* and 32*b* to which a voltage is applied, and thus collide with the exoelectron emission layer 25 at a high energy.

Therefore, the exoelectron emission layer 25 is excited at a higher density state, and accordingly, a large number of exoelectrons can be emitted in the entire process of discharge. Subsequently, the delay time of an address discharge can be significantly reduced.

In the first exemplary embodiment, the exoelectron emission layer 25 covers the regions between the bus electrodes 31*b* and 32*b*, and extends along the x-axis direction. That is, the exoelectron emission layer 25 corresponds to the bus electrodes 31*b* and 32*b*, and is formed between the adjacent bus electrodes 31*b* and 32*b*. The exoelectron emission layer 25 increases the emission amount of exoelectrons during a discharge because it maximizes the surface area while corresponding to the bus electrodes 31*b* and 32*b*.

In addition, the exoelectron emission layer may be separated and independently correspond to each of the pair of bus electrodes (not shown).

In the discharge cells 17, the exoelectron emission layer 25 is formed in the portion where no sustain discharge occurs, and hence there is no need to accumulate wall charges. In order to accumulate wall charges, high electrical insulation is required, but the exoelectron emission layer 25 does not require high electrical insulation.

Therefore, the exoelectron emission layer 25 may include a large amount of exoelectron emission material having low electrical insulation, and this may improve an address discharge delay.

Figure 4:
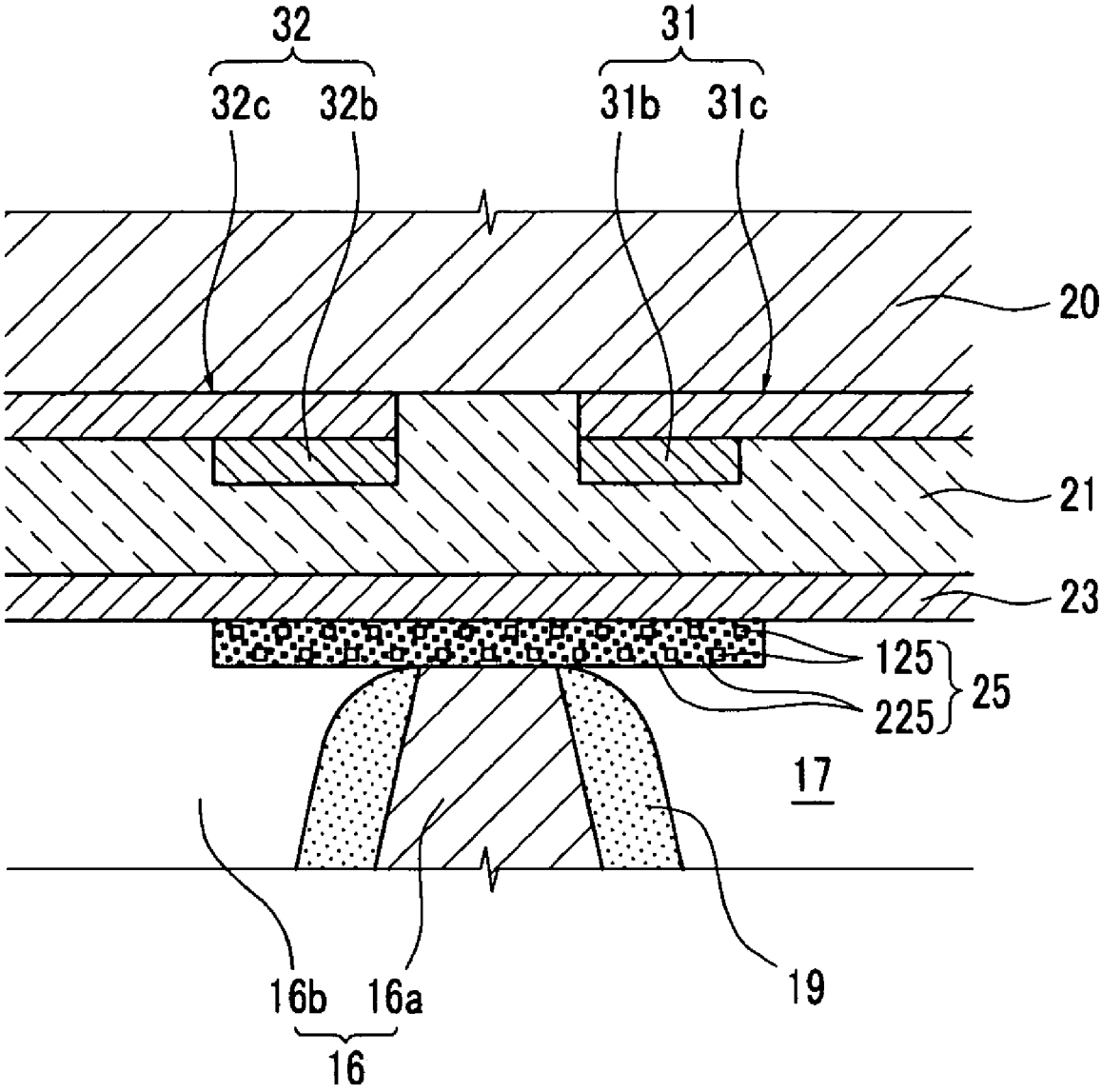
FIG. 4 is an enlarged cross-sectional view of an exoelectron emission layer.

FIG. 4 is an enlarged cross-sectional view of an exoelectron emission layer. Referring to FIG. 4, the exoelectron emission layer 25 is formed of a mixture of exoelectron emitter particles 125 and an insulating material 225. For instance, the exoelectron emitter particles 125 are formed of MgO crystal particles or MgO-containing particles. The insulation material is formed of $Al_2O_3$.

The MgO-containing particles have MgO as the main component, and can be formed by doping MgO particles with Si, doping MgO particles with Si and Cr, doping MgO particles with Sc, doping MgO particles with Sc and Si, or doping MgO particles with Sc and Ca.

The exoelectron emitter particles 125, for example MgO crystal particles, MgO-containing particles, and $Al_2O_3$ particles, have a particle diameter smaller than 200 nm. When compared with the wavelength of 400 to 700 nm of visible light emitted as the phosphor layers 19 are excited by vacuum ultraviolet rays, the particle diameter of the exoelectron emission layer 25 is sufficiently small. Therefore, the exoelectron emission layer 25 has high transparency with respect to the visible light generated from the phosphor layers 19. Accordingly, the introduction of the exoelectron emission layer 25 causes little loss of visible light.

In addition, by a particle diameter of about a half of the wavelength (150-200 nm) of vacuum ultraviolet rays generated by a discharge, the particles scatter the vacuum ultraviolet rays transmitted to the exoelectron emission layer 25 to reflect them to the phosphor layers 19, thereby further exciting the phosphor layers 19. Therefore, the luminance and light emission efficiency in the plasma display panel are improved.

The insulating material 225 provides electrical insulation to the exoelectron emission layer 25. The insulating material 225 has electrical insulation of such a degree that wall charges accumulated on the protective layer 23 in which a sustain discharge is performed may not be leaked via the exoelectron emission layer 25. Due to the prevention of leakage of wall charges, an initiation voltage and discharge current of the sustain discharge are stabilized.

The driving of the plasma display panel will now be briefly explained. A reset discharge occurs by a reset pulse applied to the scan electrodes 32 in a reset period. In an addressing period following the reset period, an address discharge occurs by the scan pulse applied to the scan electrodes 32 and an address pulse applied to the address electrodes 11. Next, in a sustain period, a sustain discharge occurs by a sustain pulse that is alternately applied to the sustain and scan electrodes 31 and 32.

The sustain and scan electrodes 31 and 32 function as electrodes that apply the sustain pulse required for the sustain discharge. The scan electrodes 32 function as electrodes that apply the reset and scan pulses. The address electrodes 11 function as electrodes that apply the address pulse. The functions of the sustain, scan, and address electrodes 31, 32, and 11 can vary depending on voltage waveforms respectively applied thereto. Therefore, the functions are not limited to those described above.

The plasma display panel selects discharge cells 17 that will be turned on by an address discharge caused by the interaction between the address and scan electrodes 11 and 32. The discharge cells 17 selected by the address discharge are then driven by the sustain discharge caused by the interaction between the sustain and scan electrodes 31 and 32, thereby displaying an image.

Figure 5:
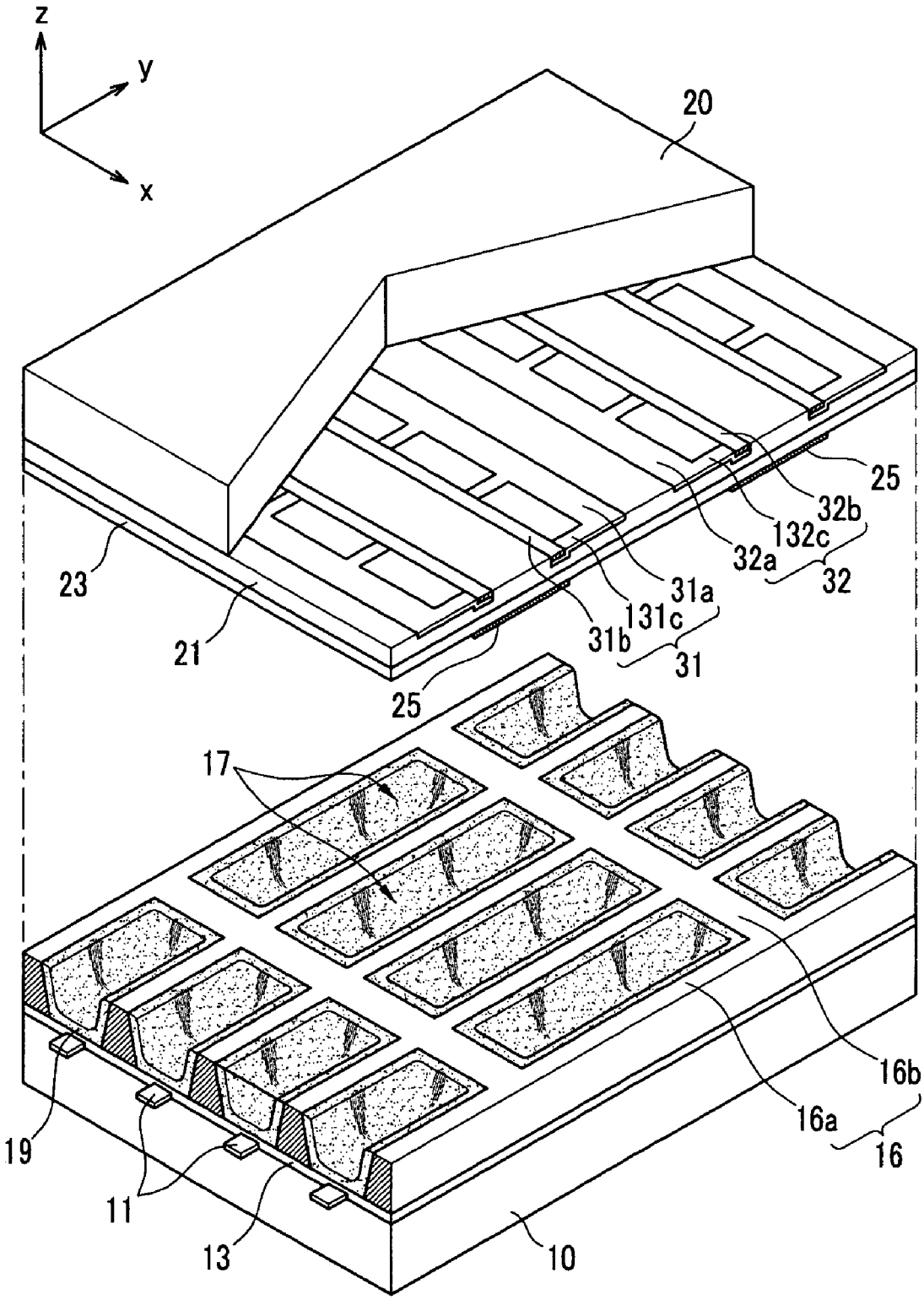
FIG. 5 is an exploded perspective view of a plasma display panel according to a second exemplary embodiment of the present invention.
Figure 6:
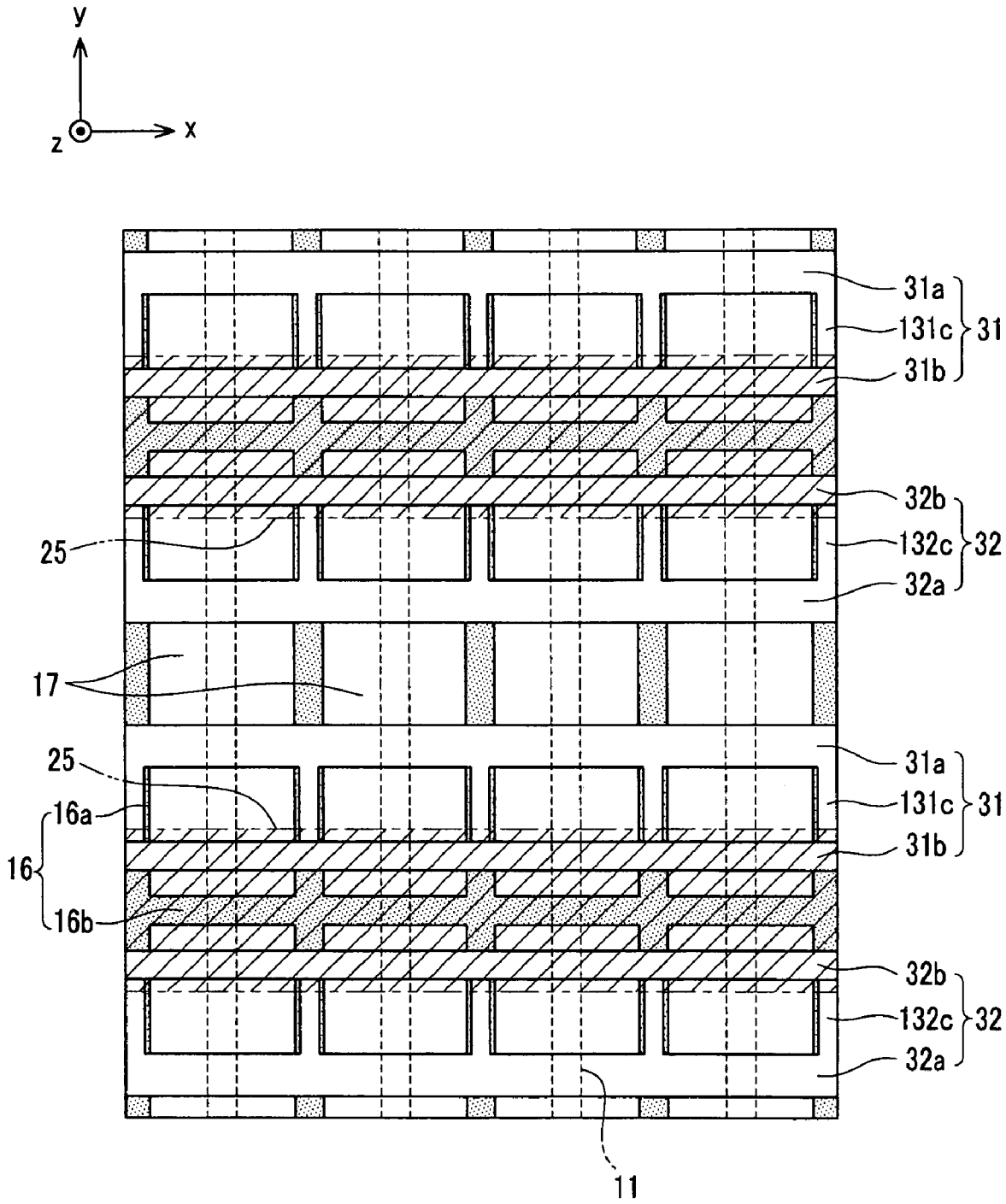
FIG. 6 is a plane view illustrating an arrangement relationship between discharge cells and electrodes in FIG. 5.

FIG. 5 is an exploded perspective view of a plasma display panel according to a second exemplary embodiment of the present invention, and FIG. 6 is a plane view illustrating an arrangement relationship between discharge cells and electrodes in FIG. 5.

Most of the components of the second exemplary embodiment are similar or identical to corresponding components for the first exemplary embodiment. Thus, a detailed description thereof will be omitted, and only different components from those of the first exemplary embodiment will be described below in detail.

In the sustain electrodes 31 and scan electrodes 32, connecting portions 131*c* and 132*c* are arranged on the barrier rib members 16. In this case, the connecting portions 131*c* and 132*c* are formed outside discharge regions, and thus visible light transmitting forward is not blocked by the connecting portions 131*c* and 132*c*. Therefore, the connecting portions 131*c* and 132*c* may be formed of the same material as the material of the bus electrodes 31*b* and 32*b* that are not transparent. In the second exemplary embodiment, if the connecting portions 131*c* and 132*c* are formed of a metal material, they have superior electrical conductivity as compared to connecting portions of the first exemplary embodiment.

The connecting portions 131*c* and 132*c* are arranged on the first barrier members 16*a* and extend in the y-axis direction. In this case, the connecting portions 131*c* and 132*c* electrically connect the bus electrodes 31*b* and 32*b* to the transparent electrodes 31*a* and 32*a*, respectively. In the second exemplary embodiment, the transparent electrodes 31*a* and 32*a* are integrally formed along the x-axis direction.

The connecting portions 131*c* and 132*c* of the second exemplary embodiment are arranged on the first barrier members 16*a*. Therefore, when compared to the connecting portions 31*c* and 32*c* of the first exemplary embodiment arranged on a space between the first barrier members 16*a* adjacent to each other along the x-axis direction, it is more difficult for the connecting portions 131*c* and 132*c* to generate a discharge.

Subsequently, it becomes more difficult to diffuse a discharge initiated at the portions corresponding to the transparent electrodes 31*a* and 32*a* from the portions corresponding to the connecting portions 131*c* and 132*c* to the portions corresponding bus electrode 31*b* and 32*b*.

Therefore, the portions corresponding to the bus electrodes 31*b* and 32*b*, i.e., the portions where the exoelectron emission layer 25 is arranged, may be non-discharge regions more apparently. Accordingly, the exoelectron emission layer 25 can suppress a negligible change because sputtering can be avoided more apparently.

Since the plasma display panel according to one exemplary embodiment of the present invention has an exoelectron emission layer formed outside the discharge regions, the address discharge delay time can be shortened by the exoelectrons emitted from the exoelectron emission layer.

In addition, the plasma display panel according to one exemplary embodiment of the present invention can improve the negligible stability of the exoelectron emission layer by protecting the exoelectron emission layer from discharge sputtering.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel, comprising:
- a first substrate;
- a second substrate facing the first substrate;
- barrier ribs arranged between the first and second substrates and defining discharge cells;
- phosphor layers formed within the discharge cells;
- address electrodes formed on the first substrate and extending along a first direction;
- first and second electrodes formed on the second substrate and extending along a second direction;
- a protective layer formed between the first and second substrates, the protective layer formed in a discharge region of the discharge cells; and
- an exoelectron emission layer formed between the first and second substrates, the exoelectron emission layer formed outside the discharge region.

2. The plasma display panel of claim 1, further comprising:
- a dielectric layer covering the first electrodes and second electrodes, the protective layer formed on the dielectric layer, the exoelectron emission layer covering a part of the protective layer.

3. The plasma display panel of claim 1, wherein each of the first and second electrodes comprises:
- a bus electrode extending in the second direction;
- a transparent electrode extending in the second direction parallel to the bus electrode; and
- a connecting portion for connecting the transparent electrode to the bus electrode; wherein the transparent electrode of one of the first electrodes and the transparent electrode of one of the second electrodes form a discharge gap.

4. The plasma display panel of claim 3, wherein the connecting portion is arranged at a center between two of the barrier ribs, both of which extend along the first direction.

5. The plasma display panel of claim 3, wherein the exoelectron emission layer is formed to cover a region between two adjacent discharge cells that are arranged in the first direction.

6. The plasma display panel of claim 5, wherein the exoelectron emission layer is formed to cover bus electrodes of the nearest first and second electrodes.

7. The plasma display panel of claim 5, wherein the exoelectron emission layer is formed to cover a region between the bus electrodes of the nearest first and second electrodes.

8. The plasma display panel of claim 1, wherein the exoelectron emission layer is formed of a mixture of exoelectron emitter particles and an insulating material.

9. The plasma display panel of claim 8, wherein the insulating material includes $Al_2O_3$.

10. The plasma display panel of claim 8, wherein the exoelectron emitter particles are formed of MgO crystal particles or MgO-containing particles.

11. The plasma display panel of claim 10, wherein:
- the exoelectron emission layer includes MgO crystal particles and $Al_2O_3$ particles; and
- the MgO crystal particles and the $Al_2O_3$ particles have a particle diameter smaller than 200 nm.

12. The plasma display panel of claim 10, wherein:
- the exoelectron emission layer includes MgO-containing particles and $Al_2O_3$ particle; and
- the MgO-containing particles have a particle diameter smaller than a wavelength of vacuum ultraviolet rays generated during a discharge.

13. The plasma display panel of claim 1, wherein the exoelectron emission layer includes particles having a particle diameter smaller than 200 nm.

14. A plasma display panel, comprising:
- first and second substrates facing each other and spaced apart from each other;
- barrier ribs arranged between the first and second substrates and defining discharge cells;
- phosphor layers formed within the discharge cells;
- address electrodes formed on the first substrate and extending along a first direction;
- first and second electrodes formed on the second substrate and extending along the second direction, each of the first and second electrodes comprises:
  - a bus electrode extending in the second direction;
  - a transparent electrode extending in the second direction parallel to the bus electrode; and
  - a connecting portion for connecting the transparent electrode to the bus electrode;
- wherein the transparent electrode of one of the first electrodes and the transparent electrode of one of the second electrodes form a discharge gap; and
- an exoelectron emission layer formed covering the bus electrodes of the first and second electrodes.

15. The plasma display panel of claim 14, wherein the exoelectron emission layer is formed of a mixture of exoelectron emitter particles and an insulating material.

16. The plasma display panel of claim 15, wherein the insulating material includes $Al_2O_3$.

17. The plasma display panel of claim 15, wherein the exoelectron emitter particles are formed of MgO crystal particles or MgO-containing particles.

18. The plasma display panel of claim 14, wherein the exoelectron emission layer includes particles having a particle diameter smaller than 200 nm.

19. The plasma display panel of claim 18, wherein:
- the exoelectron emission layer includes MgO crystal particles and $Al_2O_3$ particles; and
- the MgO crystal particles and the $Al_2O_3$ particles have a particle diameter smaller than 200 nm.

20. The plasma display panel of claim 18, wherein:
- the exoelectron emission layer includes MgO-containing particles and $Al_2O_3$ particles, and
- the MgO-containing particles and the $Al_2O_3$ particles have a particle diameter smaller than 200 nm.

* * * * *